US010156112B2

(12) United States Patent
Cotton et al.

(10) Patent No.: US 10,156,112 B2
(45) Date of Patent: Dec. 18, 2018

(54) HYBRID WELLHEAD CONNECTOR

(71) Applicant: Cameron International Corporation, Houston, TX (US)

(72) Inventors: Craig L. Cotton, Cypress, TX (US); Thomas E. Taylor, Houston, TX (US)

(73) Assignee: Cameron International Corporation, Houston, TX (US)

( * ) Notice: Subject to any disclaimer, the term of this patent is extended or adjusted under 35 U.S.C. 154(b) by 283 days.

(21) Appl. No.: 14/982,808

(22) Filed: Dec. 29, 2015

(65) Prior Publication Data

US 2017/0183932 A1 Jun. 29, 2017

(51) Int. Cl.

| | |
|---|---|
| ***E21B 33/03*** | (2006.01) |
| ***E21B 33/038*** | (2006.01) |
| *E21B 33/04* | (2006.01) |
| *E21B 33/06* | (2006.01) |

(52) U.S. Cl.

CPC ..... *E21B 33/03* (2013.01); *E21B 33/038* (2013.01); *E21B 33/04* (2013.01); *E21B 33/06* (2013.01)

(58) Field of Classification Search

CPC ..... E21B 33/03; E21B 33/04; E21B 33/06; E21B 33/038; E21B 33/02

See application file for complete search history.

(56) References Cited

U.S. PATENT DOCUMENTS

| | | | | |
|---|---|---|---|---|
| 1,835,891 | A * | 12/1931 | Mildren | E21B 33/04 251/1.3 |
| 3,268,241 | A | 8/1966 | Castor et al. | |
| 4,646,845 | A | 3/1987 | Boeker | |
| 5,110,144 | A | 5/1992 | Burton et al. | |
| 5,755,287 | A * | 5/1998 | Cain | E21B 33/038 166/368 |
| 5,996,695 | A | 12/1999 | Koleilat et al. | |
| 2004/0032088 | A1 | 2/2004 | Janoff et al. | |
| 2009/0107685 | A1 * | 4/2009 | Cain | E21B 33/03 166/379 |
| 2009/0266558 | A1 | 10/2009 | Farquharson et al. | |
| 2011/0120697 | A1 | 5/2011 | Buckle | |
| 2011/0180275 | A1 | 7/2011 | Shaw | |
| 2012/0012302 | A1 | 1/2012 | Vogel et al. | |
| 2012/0067597 | A1 | 3/2012 | Lang et al. | |

* cited by examiner

*Primary Examiner* — James G Sayre
(74) *Attorney, Agent, or Firm* — Eubanks PLLC

(57) ABSTRACT

A wellhead apparatus with a removable sealing wafer is provided. In one embodiment, an apparatus includes a wellhead housing with a pocket formed in its upper end and a wafer installed in the pocket. A flange is coupled to the exterior of the upper end of the wellhead housing, and an additional component is coupled to the wellhead housing via the flange. Further, a first seal is positioned between the wafer and a shoulder of the wellhead housing, and a second seal is positioned between the wafer and the additional component. Additional systems, devices, and methods are also disclosed.

12 Claims, 5 Drawing Sheets

HYBRID WELLHEAD CONNECTOR

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include a wellhead assembly mounted on a well through which the resource is accessed or extracted. These wellhead assemblies may include a wide variety of components, such as casings, hangers, packoffs, valves, pumps, fluid conduits, and the like, that facilitate drilling or production operations. As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Wells can also include tubing strings that facilitate flow of fluids through the wells. Hangers can be attached to the casing and tubing strings and be received within wellheads to enable these tubular strings to be suspended in the wells from the hangers. Additional components, such as blowout preventers and production trees, can also be mounted on wellheads during drilling or production operations.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to wellhead assemblies mounted over wells. In at least some embodiments, a wellhead assembly includes a wellhead housing having an upper end with a recessed pocket. A drilling adapter can be received in the pocket for drilling operations. The wellhead can be converted for production by removing the drilling adapter, installing a sealing wafer in the pocket, and attaching another component to the wellhead housing over the sealing wafer. In some instances, the drilling adapter is secured to the wellhead housing with a collar threaded onto a threaded surface of the wellhead housing, and a threaded flange is spun onto the threaded surface after removing the drilling adapter and collar to allow a flanged connection with another component. Further, elastomeric seals can be used to seal the drilling adapter to the wellhead housing, while metal seals can be used with the sealing wafer to seal the connection of the wellhead housing to a different component. In at least one such embodiment, the pocket of the wellhead housing, the sealing wafer, and the lower end of the drilling adapter enable the wellhead apparatus to convert between elastomeric sealing between the wellhead housing and the drilling adapter for a drilling phase and metal-to-metal sealing between the wafer, the wellhead housing, and an additional component for a production phase.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
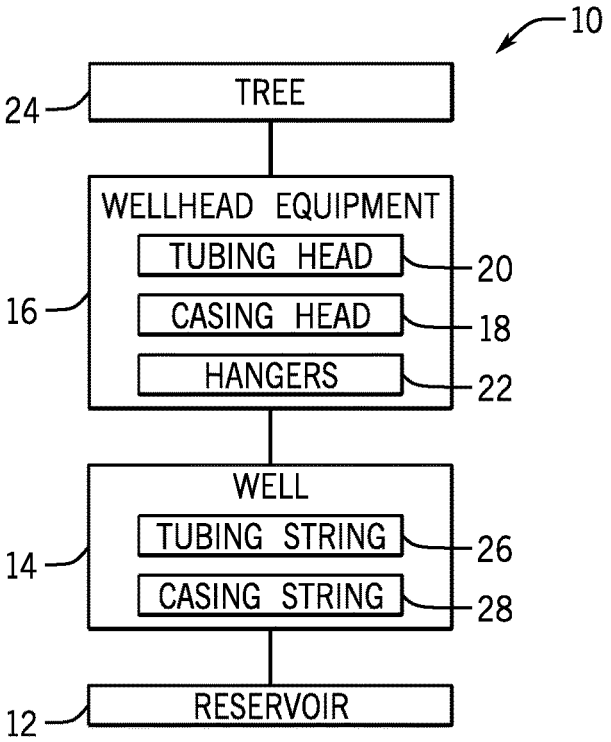
FIG. 1 generally depicts various components that can be installed at a well in accordance with one embodiment of the present disclosure.

Turning now to the present figures, a system 10 is illustrated in FIG. 1 in accordance with one embodiment. Notably, the system 10 is shown here as a production system that facilitates extraction of a resource, such as oil or gas, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, packoffs, plugs, locking assemblies, sealing assemblies, valves, and pressure gauges, to name only a few possibilities.

The wellhead hangers 22 can be positioned on landing shoulders within hollow wellhead bodies (e.g., within the tubing and casing heads). These landing shoulders can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters, and these casing strings 28 are often cemented in place within the well.

Additional equipment can be mounted on a wellhead at the well 14. For example, the depicted system 10 includes a tree 24 (e.g., a production tree), which can be mounted on the wellhead to facilitate resource production from the reservoir 12 via the well 14. It will be appreciated that the well 14 can be drilled through the wellhead, such as by a rotating drill string extending into the earth through the casing head 18. During such drilling operations, other devices (e.g., a blowout preventer) may be mounted on the wellhead in place of the tree 24. The wellhead assembly can be converted from a drilling phase to a production phase by removing the blowout preventer (or other devices) and mounting the tree 24 on the wellhead. Moreover, in at least certain embodiments of the present disclosure a hybrid connection technique can be used for connecting equipment, such as a blowout preventer and a production tree, to the wellhead at different times.

Figure 2:
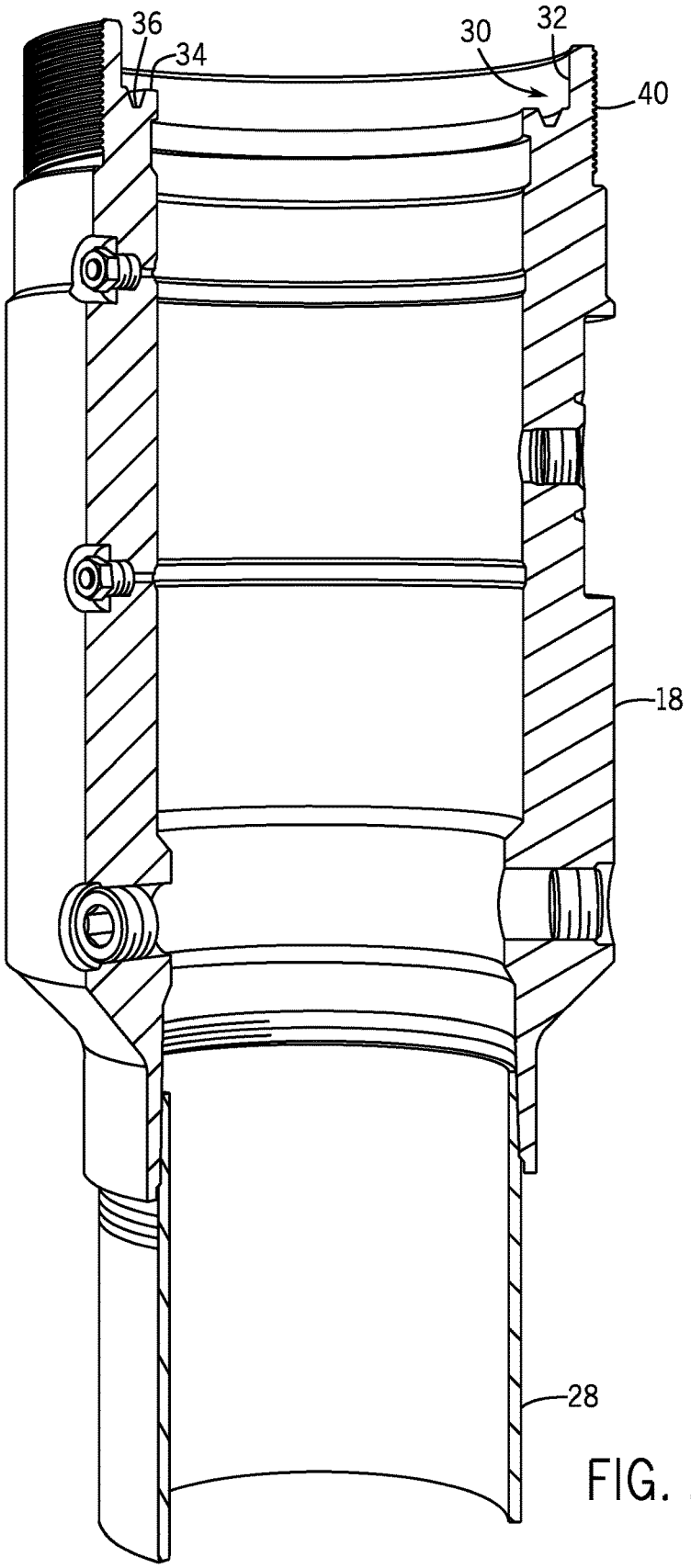
FIG. 2 is a section view of a wellhead housing having a recessed pocket in its upper end that facilitates connection to various other components in accordance with one embodiment.

By way of example, a wellhead housing in the form of a casing head 18 is generally depicted in FIG. 2 in accordance with one embodiment. It will be appreciated, however, that the wellhead housing could be provided in other forms. A casing string 28 is threaded to a lower end of the casing head 18, while the upper end of the casing head 18 includes a pocket 30 that facilitates connection of other components to the casing head 18, such as described in greater detail below. As shown in FIG. 2, the pocket 30 is formed as an interior recess in the upper end of the casing head 18 and is generally defined by a circumferential surface 32 and a shoulder 34.

A seal groove 36 is formed in the shoulder 34. As described further below, in some instances the seal groove 36 receives a seal to inhibit leakage from inside the wellhead housing along a path between the shoulder 34 and a component received within the pocket 30. In other instances, one or more elastomeric seals are positioned between the circumferential surface 32 and a different component received in the pocket 30 so as to inhibit leakage along a path between the surface 32 and the different component.

The upper end of the casing head 18 includes a threaded surface 40, which enables components to be connected to the upper end of the casing head 18 via threaded engagement. For instance, a drilling adapter 44 is shown coupled to the casing head 18 via a threaded collar or sleeve 46 in FIG. 3. The pocket 30 of the casing head 18 receives the lower end of the drilling adapter 44, and the collar 46 can be threaded down onto the threaded surface 40 to secure the adapter 44 to the casing head 18.

Figure 3:
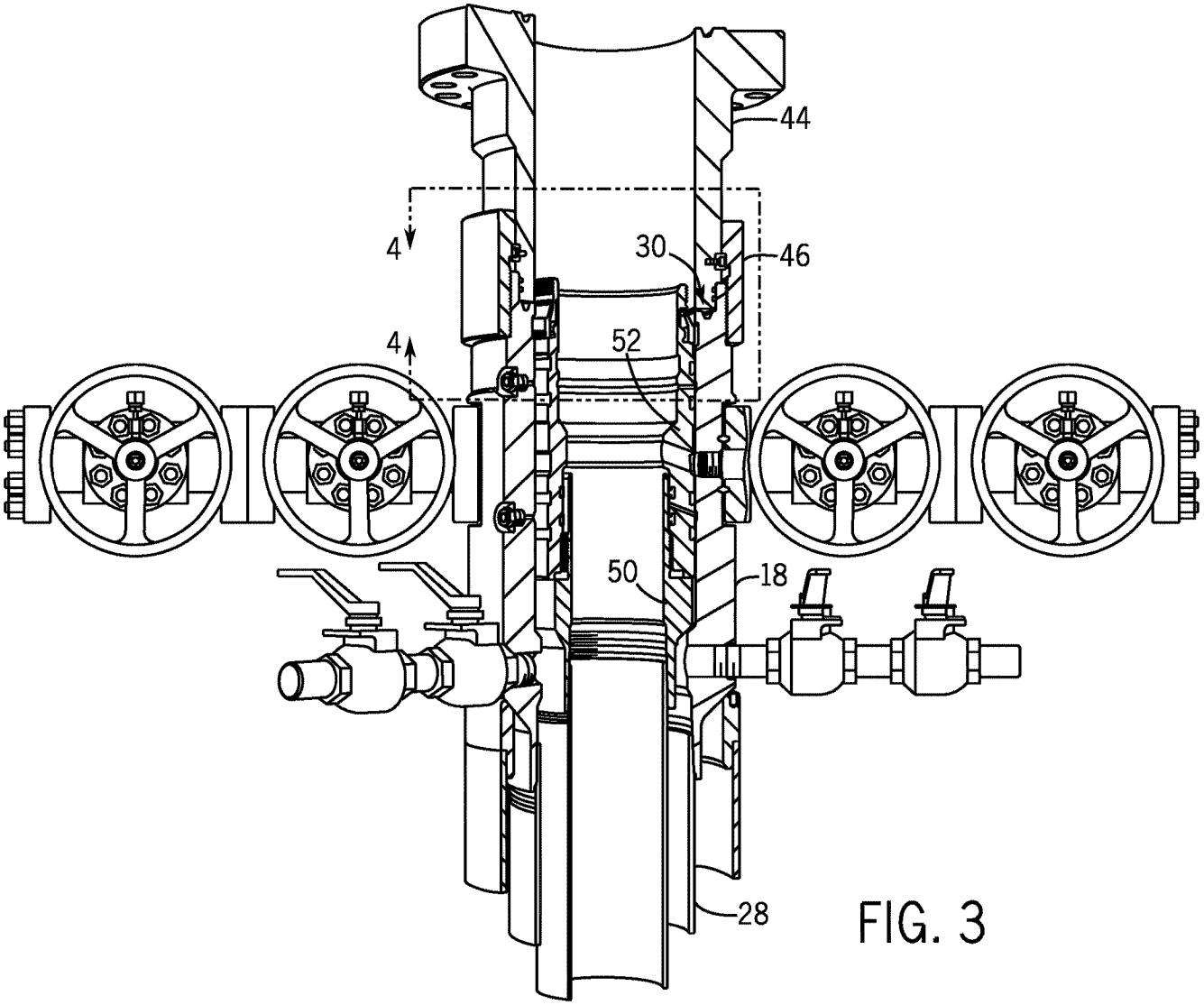
FIG. 3 depicts a wellhead assembly having the housing of FIG. 2 coupled to a drilling adapter via a threaded collar for drilling operations in accordance with one embodiment.

Various other components may be provided inside the casing head 18, as noted above. Examples of such components are depicted in FIG. 3 as including a casing hanger 50 and a packoff 52. The casing hanger 50 is connected to the top of another casing string and is landed on a shoulder within the bore of the casing head 18, while the packoff 52 is installed over the casing hanger 50. But in other embodiments the casing hanger 50 and the packoff 52 may take other forms and different components can be used in addition to, or in place of, those presently shown inside the casing head 18 in FIG. 3.

The drilling adapter 44 can take any suitable form, but is presently depicted as a tubular drilling adapter having a lower neck and an upper flange. The lower neck is received in the pocket 30, while the upper flange can be connected to another component. For example, in at least one embodiment the drilling adapter 44 is a blowout preventer adapter in which the upper flange of the adapter 44 is fastened to a blowout preventer that is to be mounted above a wellhead. That is, the upper flange of the adapter 44 is fastened to the blowout preventer (e.g., a ram-type blowout preventer), the lower end of the adapter 44 is received within the pocket 30, and the adapter 44 is secured to the casing head 18 via threaded engagement of the collar 46 with the surface 40.

Figure 4:
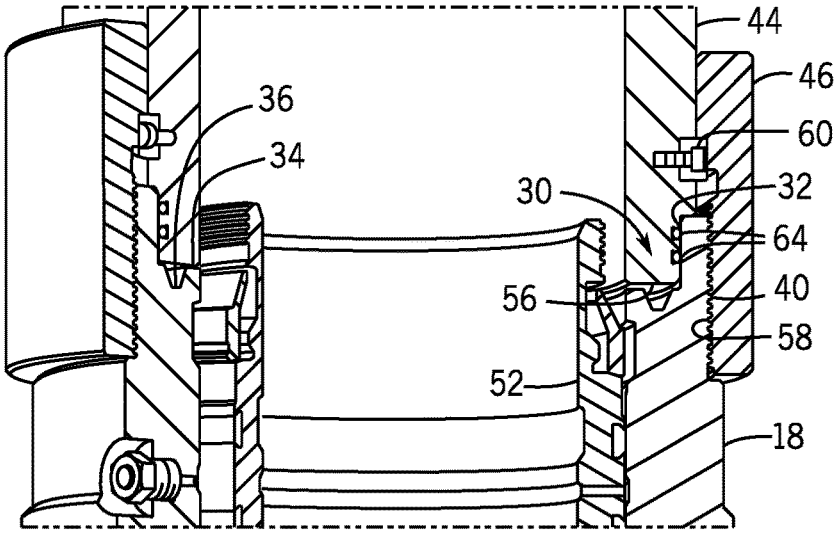
FIG. 4 is a detail view of the connection of the drilling adapter to the wellhead housing shown in FIG. 3.

The connection of the drilling adapter 44 to the casing head 18 via the collar 46 is shown in greater detail in FIG. 4. To connect the drilling adapter 44 to the casing head 18, a lower end 56 of the drilling adapter 44 can be moved into the pocket 30 and the collar 46 can be rotated onto the casing head 18 via engagement of mating threaded surfaces 40 and 58. As depicted here, a retaining ring 60 is connected to the lower end of the drilling adapter 44 to retain the collar 46 on the adapter before connection with the casing head 18. Once the collar 46 is threaded down onto the casing head 18, one or more set screws could be used to inhibit further rotation of the collar 46 (e.g., to prevent inadvertent unthreading of the collar 46 from the casing head 18).

One or more elastomeric or metal seals can be used to seal the connection between the upper end of the casing head 18 (or another wellhead housing having a pocket 30) and other components coupled to the casing head. During a drilling phase, an operator may prefer a drilling adapter 44 that allows a quick connection of other components (e.g., a blowout preventer) to the wellhead housing. Such an arrangement is generally depicted in FIG. 4, in which elastomeric seals 64 are carried by the lower neck at the end 56 of the drilling adapter 44. These elastomeric seals 64 seal against the circumferential surface 32 of the pocket 30 and inhibit leakage of fluid along a path between the drilling adapter 44 and the circumferential surface of the pocket. The arrangement of the seals 64 about the lower neck of the drilling adapter 44 facilitates quick connection of the drilling adapter 44 to the casing head 18 by allowing the drilling adapter 44 to be lowered into the pocket 30 and secured with the collar 46, as described above, without having to make up a flanged connection between the drilling adapter and the casing head.

In other cases, such as during a production phase following drilling operations, metallic sealing may be desired between the casing head 18 (or other wellhead housing) and a component coupled to the casing head. For example, metal-to-metal sealing may be used when mounting a tubing head or a production tree over the casing head 18. In accordance with at least certain embodiments, the upper end of a wellhead housing body (e.g., the casing head 18) including the pocket 30 is a hybrid connector that enables alternation between quick connections of certain components to the upper end of the wellhead housing and flanged connections of other components to the upper end of the wellhead housing.

Figure 5:
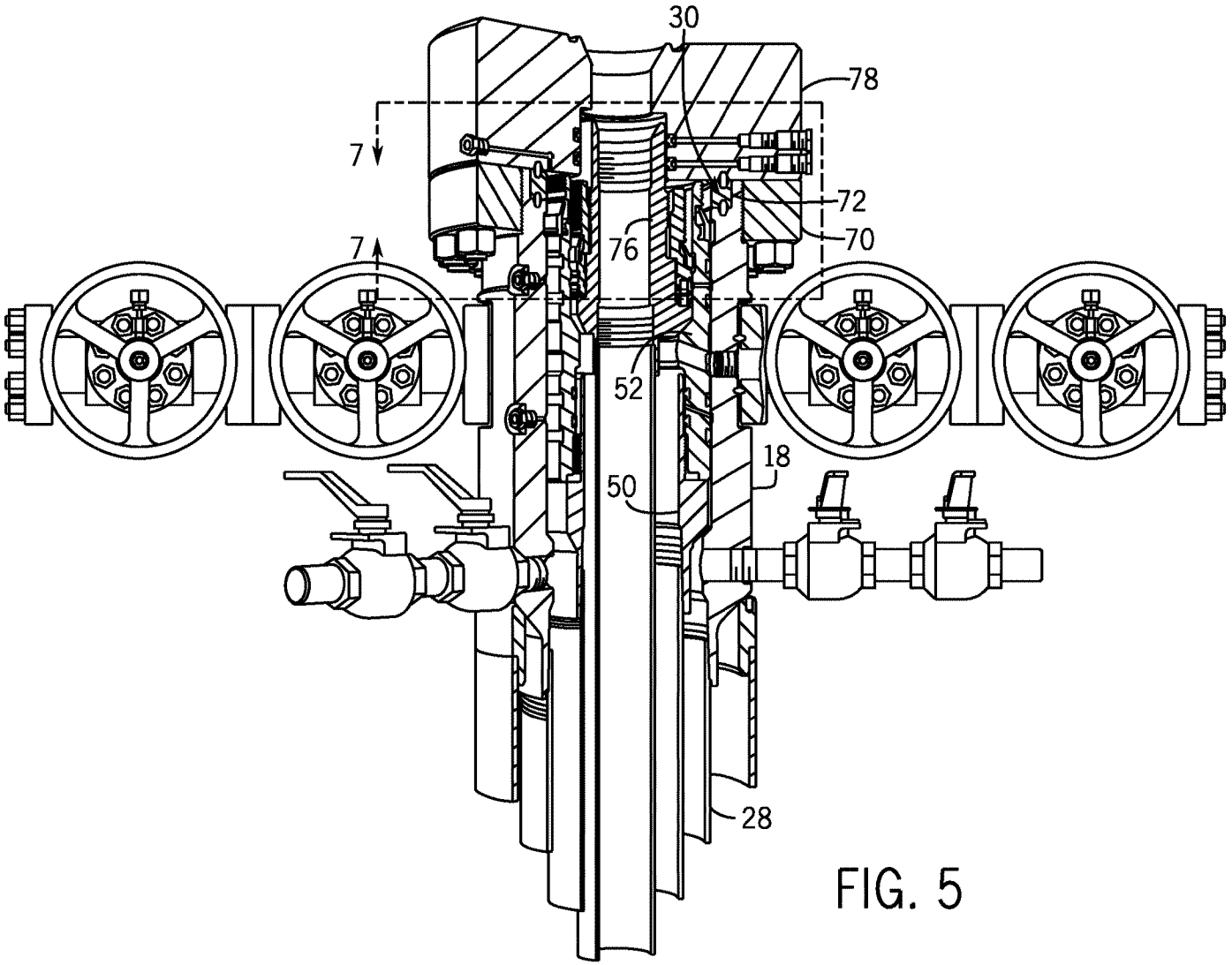
FIG. 5 depicts the wellhead assembly of FIG. 3 following removal of the drilling adapter, installation of a sealing wafer in the recessed pocket, and connection of an additional component to the wellhead housing in accordance with one embodiment.

In at least one embodiment, a wellhead is converted for production following drilling operations by uncoupling the drilling adapter 44 and its attached blowout preventer from the casing head 18 and coupling some other component, such as a production tree 24, to the casing head 18 in its place. The drilling adapter 44 can be removed from the casing head 18 by unthreading the collar 46 from the threaded end 40 of the wellhead housing and then lifting the drilling adapter 44 out of the pocket 30. Once the drilling adapter 44 is removed, a threaded flange 70 can be threaded onto the surface 40 of the casing head 18, as is shown in FIG. 5. This allows other components (e.g., additional component 78) to be made up with the wellhead housing through connection to the flange 70. The additional component 78 is depicted in FIG. 5 as an adapter flange (which can also be referred to as a crossover hub) that can be connected to the lower end of a tree 24 (or some other component) to facilitate coupling of the tree 24 to the casing head 18. In other embodiments, a flanged component (e.g., a tubing head 20) could be mounted on the casing head 18 without a crossover hub, with a lower flange of the flanged component fastened to the flange 70 of the casing head 18. It will be appreciated that other equipment can be installed in the casing head 18 following removal of the drilling adapter 44 from the pocket 30. A wellhead hanger 76 (e.g., a tubing hanger) and another packoff are depicted in FIG. 5 as examples of such other equipment, but any suitable devices could also or instead be installed in the casing head 18 after removal of the drilling adapter 44.

Figure 6:
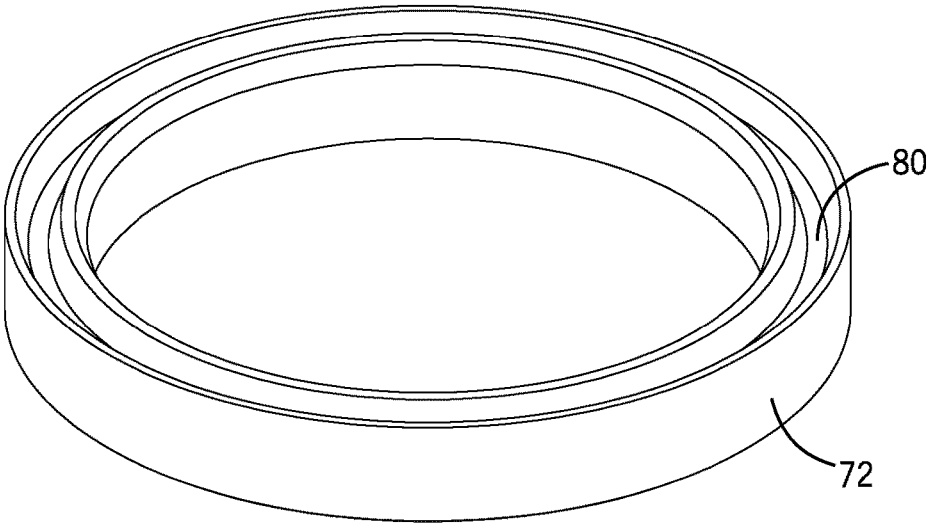
FIG. 6 is a perspective view of the sealing wafer of FIG. 5.

As further shown in FIG. 5, a sealing wafer 72 can be installed in the pocket 30 of the wellhead housing following removal of the drilling adapter 44 from the pocket. This sealing wafer 72 is depicted by itself in FIG. 6, and a detail view of the sealing wafer 72 installed in the pocket 30 is provided in FIG. 7. The sealing wafer 72 is depicted as a ring-shaped wafer in FIG. 6, though the wafer may take other forms in different embodiments.

Figure 7:
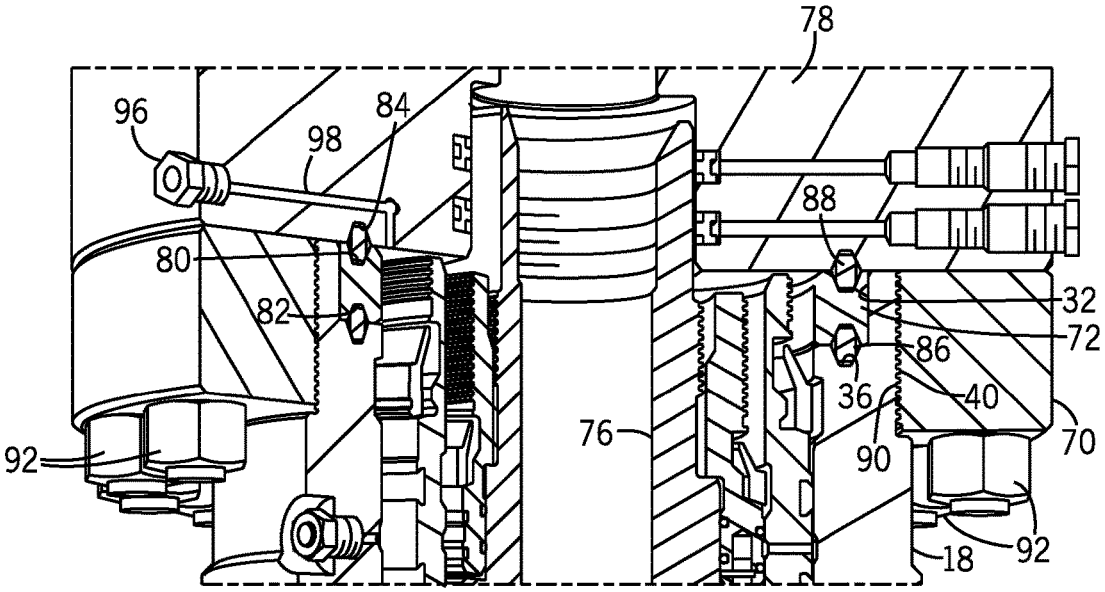
FIG. 7 is a detail view of the connection of the additional component to the wellhead housing shown in FIG. 5.

As best shown in FIG. 7, opposite ends of the sealing wafer 72 include seal grooves 80 and 82 for receiving seals 88 and 86, respectively. Particularly, the seal 86 is positioned in the groove 82 of the wafer 72 and in the mating groove 36 in the shoulder 34 of the casing head 18. Similarly, the seal 88 is positioned in the groove 80 of the wafer 72 and in a mating groove 84 of the additional component 78. In at least some instances, the seals 86 and 88 are metal ring gaskets that provide metal-to-metal sealing between the wafer 72 and adjacent components (i.e., the casing head 18 and the additional component 78). The seal 86 inhibits fluid leakage from the wellhead housing between the sealing wafer 72 and the wellhead housing, while the seal 88 inhibits fluid leakage from the wellhead housing between the wafer 72 and the additional component 78.

The flange 70 includes a threaded surface 90 that mates with the corresponding surface 40 of the casing head 18, and the additional component 78 is coupled to the casing head 18 via the flange 70. More specifically, in the presently depicted embodiment the additional component 78 is fastened to the flange 70 with a threaded connection provided by studs and nuts 92. This threaded connection can be tightened (by rotating the nuts 92 on the studs) to draw the additional component 78 toward the casing head 18 and energize the seals 86 and 88. The additional component 78 in FIG. 7 includes an external test port 96 in fluid communication with an interior of the wellhead housing via conduit 98, and this test port 96 can be used to pressure test the seals 86 and 88 to verify proper sealing.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a tubular drilling adapter having a lower neck;

a sealing wafer with seal grooves in opposite sides of the sealing wafer; and a wellhead housing having a body with a recessed end for alternately receiving the lower neck of the tubular drilling adapter and the sealing wafer, the recessed end including a circumferential surface and a shoulder, wherein the recessed end of the wellhead housing body, the sealing wafer, and the lower neck are configured to facilitate sealing between the lower neck and the circumferential surface of the recessed end when the tubular drilling adapter is received in the recessed end, and to facilitate sealing between the sealing wafer and the shoulder of the recessed end when the sealing wafer is received in the recessed end.

2. The apparatus of claim 1, comprising an elastomeric seal carried on the lower neck of the tubular drilling adapter.

3. The apparatus of claim 1, wherein the sealing wafer is positioned in the recessed end with a metal ring gasket positioned in one of the seal grooves of the sealing wafer and in a mating seal groove in the shoulder of the recessed end of the wellhead housing.

4. The apparatus of claim 1, wherein the recessed end of the wellhead housing body, the sealing wafer, and the lower neck enable the apparatus to convert between elastomeric sealing between the wellhead housing and the tubular drilling adapter for a drilling phase and metal-to-metal sealing between the wafer, the wellhead housing, and an additional component for a production phase.

5. The apparatus of claim 1, wherein the tubular drilling adapter is a flanged blowout preventer adapter.

6. A method for converting a wellhead for production following drilling operations, the method comprising:

uncoupling a drilling adapter from a wellhead housing following drilling operations;

installing a sealing wafer within a pocket of the wellhead housing vacated by the uncoupling of the drilling adapter from the wellhead housing;

positioning a seal in a groove of the sealing wafer; and coupling an additional component to the wellhead housing such that the additional component contacts the seal positioned in the groove of the sealing wafer and the seal inhibits fluid leakage from the wellhead housing between the sealing wafer and the additional component.

7. The method of claim 6, wherein uncoupling the drilling adapter from the wellhead housing includes unthreading a collar on the drilling adapter from a threaded end of the wellhead housing and then lifting the drilling adapter out of the pocket of the wellhead housing.

8. The method of claim 7, comprising threading a flange onto the threaded end of the wellhead housing.

9. The method of claim 8, wherein coupling the additional component to the wellhead housing includes fastening the additional component to the flange threaded onto the threaded end of the wellhead housing.

10. The method of claim 6, comprising positioning an additional seal between the sealing wafer and the wellhead housing such that the seal inhibits fluid leakage from the wellhead housing between the sealing wafer and the wellhead housing.

11. The method of claim 10, comprising pressure testing sealing of the seal between the sealing wafer and the additional component, and of the additional seal between the sealing wafer and the wellhead housing, via a test port and conduit through the additional component.

12. The method of claim 10, comprising tightening a threaded connection to draw the additional component toward the wellhead housing so as to energize the seal between the sealing wafer and the additional component and the additional seal between the sealing wafer and the wellhead housing.

* * * * *